US008761416B2

(12) United States Patent
Hakansson

(10) Patent No.: US 8,761,416 B2
(45) Date of Patent: Jun. 24, 2014

(54) BONE CONDUCTION TRANSDUCER WITH IMPROVED HIGH FREQUENCY RESPONSE

(75) Inventor: Bo Hakansson, Gothenburg (SE)

(73) Assignee: Osseofon AB, Gothenburg (SE)

( * ) Notice: Subject to any disclaimer, the term of this patent is extended or adjusted under 35 U.S.C. 154(b) by 297 days.

(21) Appl. No.: 13/377,859

(22) PCT Filed: Mar. 22, 2010

(86) PCT No.: PCT/SE2010/000066

§ 371 (c)(1),
(2), (4) Date: Dec. 13, 2011

(87) PCT Pub. No.: WO2010/110713

PCT Pub. Date: Sep. 30, 2010

(65) Prior Publication Data

US 2012/0083860 A1 Apr. 5, 2012

(30) Foreign Application Priority Data

Mar. 24, 2009 (SE) ..... 0900372

(51) Int. Cl.
*H04R 25/00* (2006.01)

(52) U.S. Cl.
USPC ..... 381/151; 381/326

(58) Field of Classification Search
USPC ..... 381/151, 190, 312, 326, 150, 322; 600/25; 607/55, 57
See application file for complete search history.

(56) References Cited

U.S. PATENT DOCUMENTS

2004/0097785 A1 5/2004 Schmid et al.
2005/0101830 A1 5/2005 Easter et al.
2005/0249366 A1 11/2005 Westerkull
2007/0053536 A1 * 3/2007 Westerkull ..... 381/326

FOREIGN PATENT DOCUMENTS

WO 03001846 A1 1/2003
WO 03096744 A1 11/2003

OTHER PUBLICATIONS

International Search Report, corresponding to PCT/SE2010/000066, mailed on Jun. 29, 2010.
Written Opinion, corresponding to PCT/SE2010/000066, mailed on Jun. 29, 2010.
International Preliminary Report on Patentability, corresponding to PCT/SE2010/000066, date of issuance of this report is Sep. 27, 2011.

* cited by examiner

*Primary Examiner* — Matthew Eason
(74) *Attorney, Agent, or Firm* — Renner, Otto, Boisselle & Sklar, LLP.

(57) ABSTRACT

A bone conduction transducer comprising a first seismic mass and a second mass connected to each other by a first spring suspension, and where the first mass and the first spring suspension creates a first mechanical resonance $f_1$ in the low frequency range, and that a second mechanical resonance $f_2$ is created in the high frequency range by interaction between the second mass and a second spring compliance that is introduced between the second mass and the skull.

13 Claims, 7 Drawing Sheets

Prior Art a)

BONE CONDUCTION TRANSDUCER WITH IMPROVED HIGH FREQUENCY RESPONSE

TECHNICAL FIELD

The present invention relates to vibration generating transducers for bone conduction hearing devices.

BACKGROUND OF THE INVENTION

Bone conduction hearing devices are used by patients who can not use conventional air conduction hearing aids e.g., due to chronic middle ear disease or a congenital/acquired deformity.

A traditional low cost bone conduction hearing device consists of a bone conduction transducer enclosed in a plastic housing which is pressed with a constant pressure of 3-5 Newton against the skin over the bone behind the ear. Microphone, amplifier, and power source are placed in their own housing at a suitable site and at a secure distance from the transducer to avoid feedback problems. The most essential drawbacks of this type of bone conduction hearing devices are that it is uncomfortable to wear due to the constant pressure and that the soft skin over the bone deteriorate the transmission of vibrations to the bone.

Since the beginning of the 1980's there is a second type bone conduction device—the bone anchored hearing aid (BAHA)—where the bone conduction transducer is connected directly to the bone via a skin penetrating and bone anchored implant of titanium, cf e.g., SE8107161, SE9404188 or Tjellström et al. 2001. In this way a bone conduction hearing device is obtained which provides higher amplification, improved wearing comfort, and where all parts can be enclosed in the same housing.

In the future there may be a third generation of bone conduction hearing devices where the transducer is supposed to be implanted completely and thereby skin and soft tissue can remain intact. Signal and necessary energy can in this case be transferred through intact skin by means of inductive coupling, as described by Håkansson et al. 2008. At more severe hearing damages where the energy demand is large the energy can be transferred by means of skin penetrating (percutaneous) electric connection device, cf e.g., SE9704752. The advantages implanting the whole transducer into the temporal bone compared with a transducer being externally situated are, besides the pure medical ones, that an increased sensitivity is obtained, the size of the externally placed unit becomes smaller and stability margins are improved.

It is of course of utmost importance that all bone conduction transducers in general and implantable ones in particular are efficient and keep current consumption low and that the sensitivity i.e. output force over the whole frequency range is high enough.

To achieve sufficiently high low frequency sensitivity conventional transducers are designed to have a first resonance created from the interaction between the counterweight mass and the suspension compliance (elasticity). Both the mass and the compliance are also needed from inherent reasons i.e. the suspension compliance is needed to prevent air gaps from collapsing and the counter weight mass is needed to induce the forces created in the airgap to the load. This low frequency resonance is typically placed somewhere between 200-1000 Hz and gives the transducer a low frequency sensitivity boost. However, it is well known that bone conduction devices suffer from a limited maximum output at high frequencies, especially if compared with air conduction devices. To improve the sensitivity of bone conduction transducers in the high frequency area is the major objective behind the present invention.

The present innovation is also applicable to other applications than bone conduction hearing aids such as transducers for bone conduction communication systems, audiometric and vibration testing devices.

PRIOR ART

A cross-section of conventional variable reluctance type bone conduction transducers are shown in FIGS. 1*a* and 1*b* (State of the Art). The transducer in FIG. 1*a* is of the balanced type whereas the transducer in FIG. 1*b* is of the unbalanced type. For a more detailed description of the balanced design see for example Ser. No. 10/237,391 and Håkansson 2003.

Both types of transducers are supposed to be connected to a patient ($Z_{load}$) either via a bone anchored implant and a coupling of some sort or via a casing, capsulating the transducer, which in turn is in contact with the bone tissue. Normally in direct bone conduction applications one assumes that the load impedance i.e. the skull impedance is much higher than the transducers mechanical output impedance i.e. the load do not significantly affect the transducers force generating performance.

The counter weight with total mass m1 is engaging electromagnetically with the driving side of the transducer having a total driving mass m2. One or more suspension springs with total compliance C1 is needed to maintain stable airgaps, formed in between m1 and m2, in which the dynamic forces are created by the electromagnetic circuits (only symbolically depicted in FIG. 1*a* and 1*b*).

The primary task of the mass $m_1$ is to act as a counter weight for the dynamic forces generated in the airgaps and to create a low frequency resonance to boost the low frequency sensitivity. The resonance frequency $f_1$ relates approximately to Equ. 1.

$$f_1 \cong \frac{1}{2\pi\sqrt{c_1 m_1}} \text{ Hz} \qquad \text{Equ. 1}$$

As shown in FIG. 1 the mass of the coil (S2) is included in the driving mass m2 for the balanced design whereas the coil (S1) is included in the counter weight mass m1 for the unbalanced design. The resonance frequency may, in accordance with Equ. 1, be lowered by either increasing the total weight of the counter weight mass m1 or increasing the compliance of the total spring suspensions C1.

SUMMARY OF THE PRESENT INVENTION

The present innovation comprise of a new design to improve the high frequency performance of bone conduction transducers. The new design is based on that a compliant member is introduced between the driving mass of the transducer and the load thereby creating a resonance between that compliance and the driving mass in the high frequency region. This resonance will improve the response in that frequency region.

DETAILED DESCRIPTION

Figure 1:
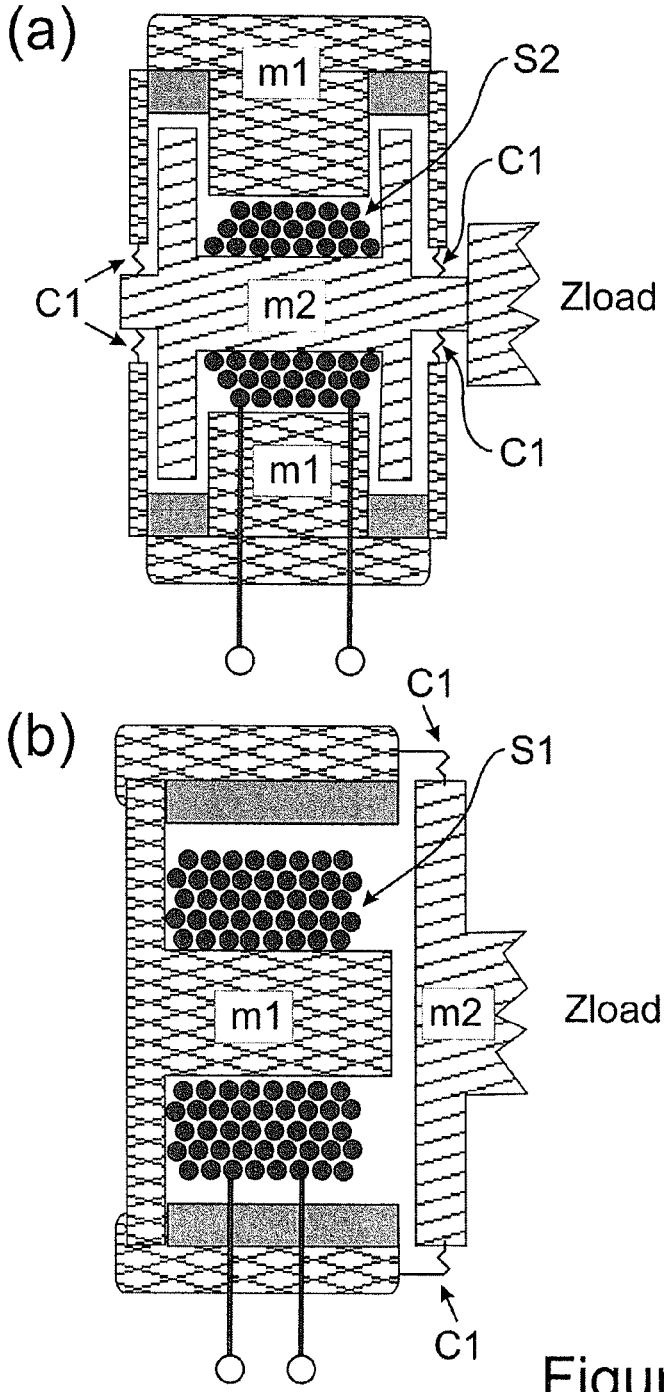
FIG. 1*a, b*: Prior art—cross-section of (a) balanced and (b) unbalanced conventional variable reluctance transducer.
Figure 2:
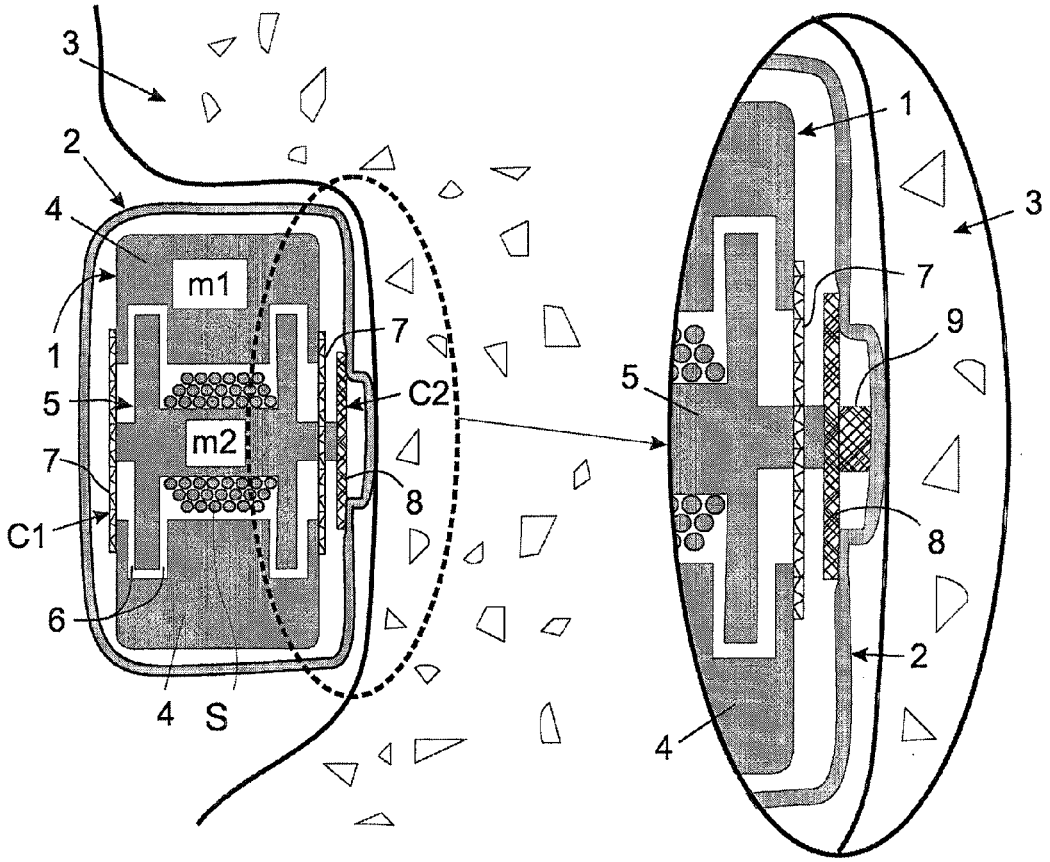
FIG. 2: Cross-section of a preferred embodiment of the invention with the second suspension compliance permanently in place.

A first embodiment according to the present invention is shown in FIG. 2. In this embodiment the transducer (1) is capsulated in a housing (2) of biocompatible material for implantation in the skull bone (3). In this example a balanced design (FIG. 1*a*) is used but also an unbalanced design (FIG. 1*b*) could used. The counter weight unit consisting of soft iron material and magnets with total mass m1 (4) is engaging with driving side unit consisting of soft iron material and including the coil with total mass m2 (5) forming small air gaps (6) in between. In order to maintain stable and balanced airgaps there is needed a first spring suspension arrangement (7) with total compliance C1 that in one end is attached to the seismic mass unit (4) and in the other end is attached to the driving side unit (5). The suspension spring arrangement (7) can typically be made of one or more blade springs and they may have damping material attached (not shown) to give the resonance peak an appropriate shape. The mass m1 of counter weight unit (4) and the compliance C1 of the first suspension spring form a low frequency resonance f1 according to Equ. 1. This low frequency resonance is designed to boost the low frequencies in the range from 200 to 1000 Hz.

In a conventional transducer the driving mass unit (5) is directly attached to the housing (2) whereas in this invention a second suspension arrangement (8) with total compliance C2 is placed in between the driving mass unit (5) and the housing (2). The housing (2) is directly attached to the skull bone (3) either directly or via a bone anchored coupling (not shown). Hence the mass m2 and the compliance C2 form a second resonance frequency according to Equ 2. This resonance is designed to boost the high frequencies in the range approximately from 1 k to 7 kHz $$f_2 \cong \frac{1}{2\pi\sqrt{c_2 m_2}} \text{ Hz} \qquad \text{Equ. 2}$$

The second suspension (8) may have some damping material (9) attached between the spring and the housing as shown in FIG. 2 or directly on the spring surface (not shown).

Figure 3:
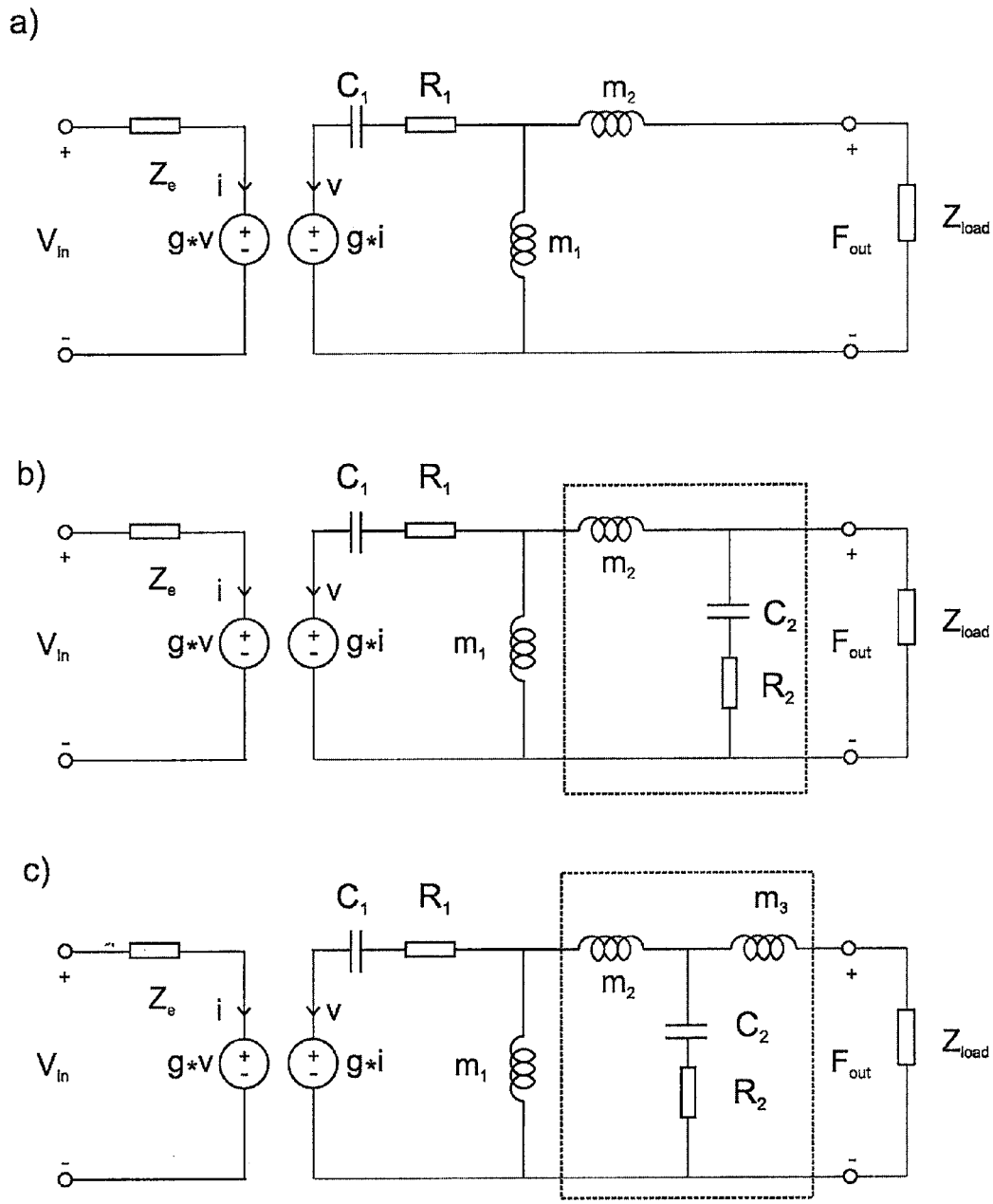
FIG. 3*a, b, c*: Electro-mechanical lumped parameter models of (a) prior art and (b) present innovation and (c) a modification of present innovation.

In FIGS. 3*a, b*, and *c* electro-mechanical analogue lumped parameter networks of the transducer designs are shown. There are some more parameters in FIG. 3 not described above such as the electrical input impedance Ze, the electromagnetic conversion factor g, the damping of the first suspension spring R1, the damping of the second suspension spring R2 and the mechanical load impedance $Z_{load}$. The load impedance $Z_{load}$ is the mechanical impedance of the skull which has been described in more detail by Håkansson et al. 1986. The conventional (prior art) model is shown in FIG. 3*a* and the model of the new invention is shown in FIG. 3*b* where the second suspension compliance C2 is added. If desired some damping R2 can be added. Generally the values m2, C2 and R2 are chosen to give a desired resonance frequency $f_2$ and an appropriate shape of the frequency response in the high frequency region but considering that other parameters have some influence as well. It should also be noted that appropriate damping of C2 can be achieved by the damping R1 only as R1 and R2 are in series, see FIG. 3*a* and *b*. The damping of resonances $f_1$ and $f_2$ can also be introduced electronically as described in SE 0302489-0 instead of using R1 and/or R2. In FIG. 3*c* it is also shown that an additional mass m3 can be introduced between the mechanical load and the second compliance C2 to take into account the mass of the housing or just to increase the impedance of the load to avoid interaction between the load $Z_{load}$ and the resonance network m2 and C2.

Figure 4:
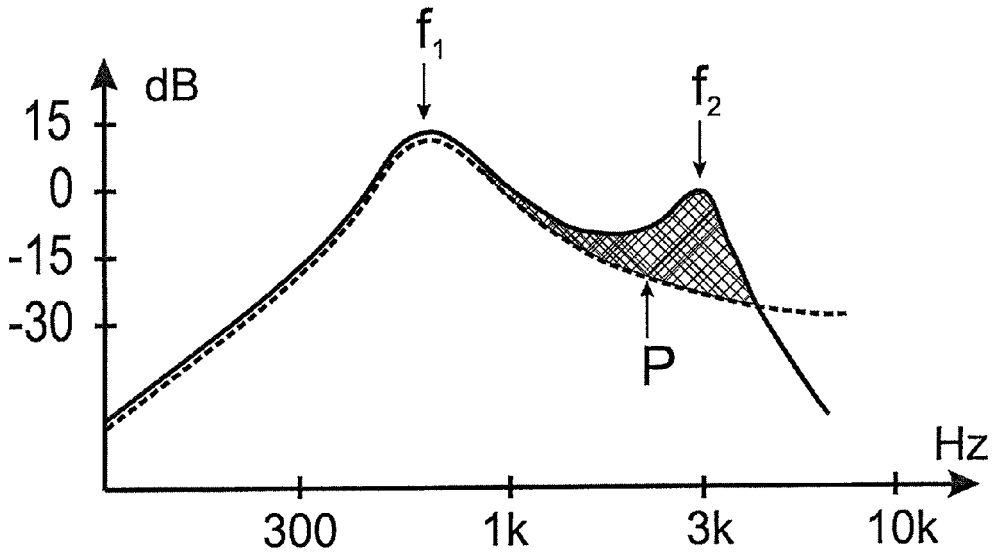
FIG. 4: Frequency responses of Prior art (P) and present innovation (solid line).

In FIG. 4 the graphs show the prior art frequency response (dashed line) and the frequency response of the present innovation (solid line). It is obvious that the present innovation can give a high frequency boost shown by the cross hatched area by up to 20 dB at the resonance frequency $f_2$ which here is designed to be approx. 3 kHz. In this example the improvement in sensitivity starts already slightly above 1 kHz and ends below 5 kHz. This frequency range from 1-5 kHz is very important for speech understanding. Improving the performance of the transducer in this frequency range is main purpose with the present innovation.

Figure 5:
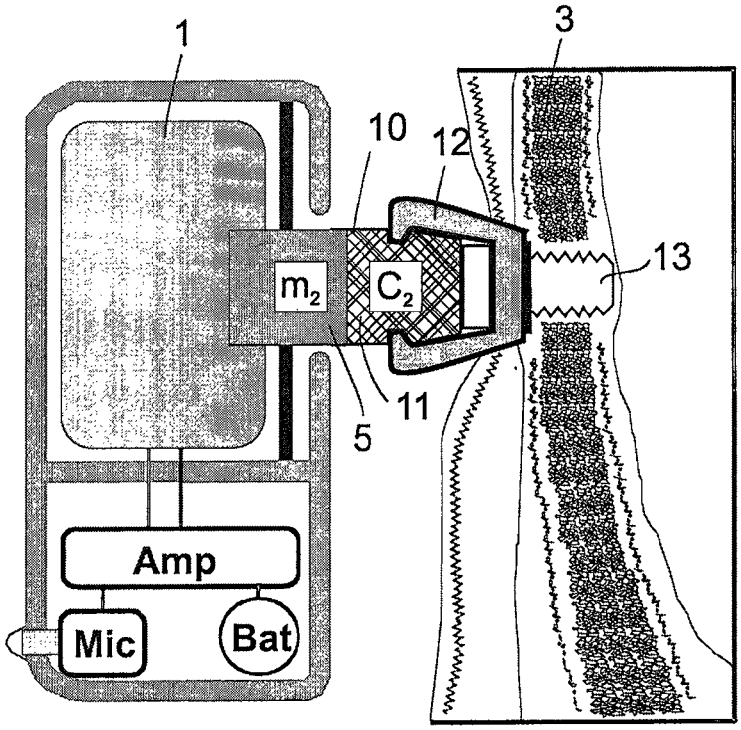
FIG. 5*a, b*: Cross-section of a preferred embodiment of the present invention using a snap arrangement (a) engaging internally or (b) engaging externally to a skin penetrating abutment.
Figure 5:
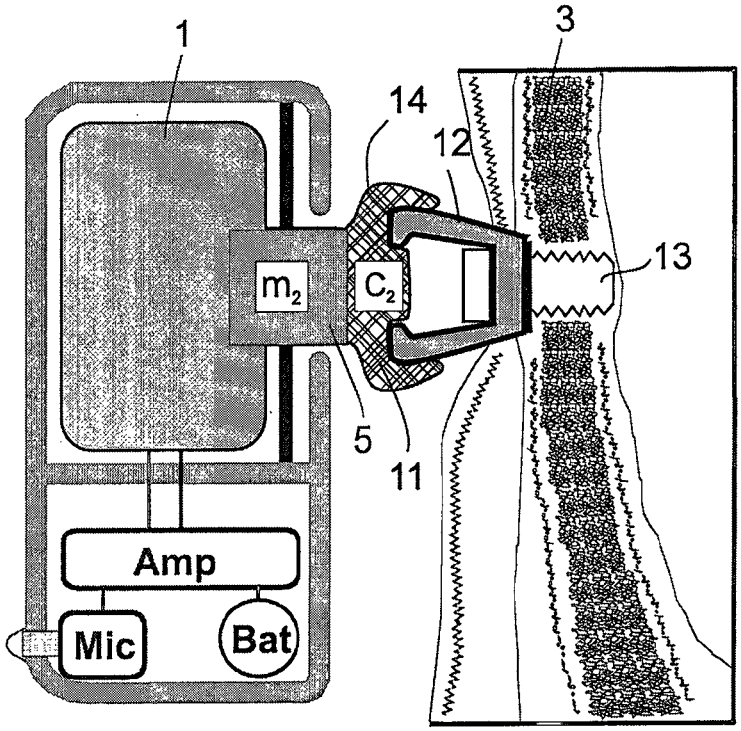

In FIG. 5*a, b* it is shown one embodiment of the present innovation where a snap coupling is modified to create a second resonance frequency $f_2$. In FIG. 5*a* the snap male unit (10) constitute the second compliant member (11) with compliance C2 that is attached to the driving mass unit (5) of the transducer. Here the compliant member (11) is snapped into the female part formed by the skin penetrating abutment (12) that is firmly attached to the bone anchored titanium screw (13). In FIG. 5*b* the snap parts are reversed i.e. the female part (14) constitute the second compliant member C2 (11) and is in one end attached to the driving mass unit (5) of the transducer and in the other snapped onto the outer portion of the skin penetrating abutment (12). It should be noted that the snap coupling used in the present BAHA (SE 9404188-6) is designed so that the inherent compliance that exist in any coupling is so stiff that the resonance occurs in a frequency range above the useful range of frequencies for hearing impaired which was deemed to be around 10 kHz. In this way potential feedback problems could be avoided and it was also thought to expand the frequency range of the device. Therefore, if the snap coupling for a BAHA is worn out and the resonance was decreased to around 8 kHz it should be replaced according to the instructions as it often then was also insufficiently attached and unintentionally was released from the implant.

Figure 6:
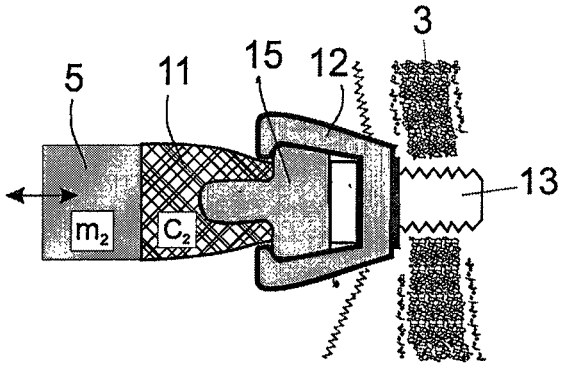
FIG. 6*a, b*: Cross-section of a preferred embodiment of the present invention for attachment of the external transducer using a coupling engaging to an adaptor fitted into a skin penetrating abutment where the compliant material could be placed either (a) on transducer side or (b) interiorly of the abutment.
Figure 6:
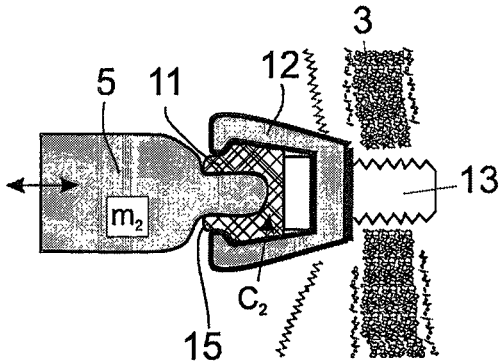

In FIG. 6*a, b* other embodiments of the present innovation are shown. In FIG. 6*a* an adapter unit (15) is rigidly attached to the interior part of the skin penetrating abutment (12). The driving mass unit (5) of the transducer with the compliant member (11) on top is snapped or pressed onto the adapter unit (15). In FIG. 6*b* the coupling units are reversed i.e. the adapter unit constitute the compliant member (11) and the driving mass unit (5) of the transducer is snapped or coupled to it.

Figure 7:
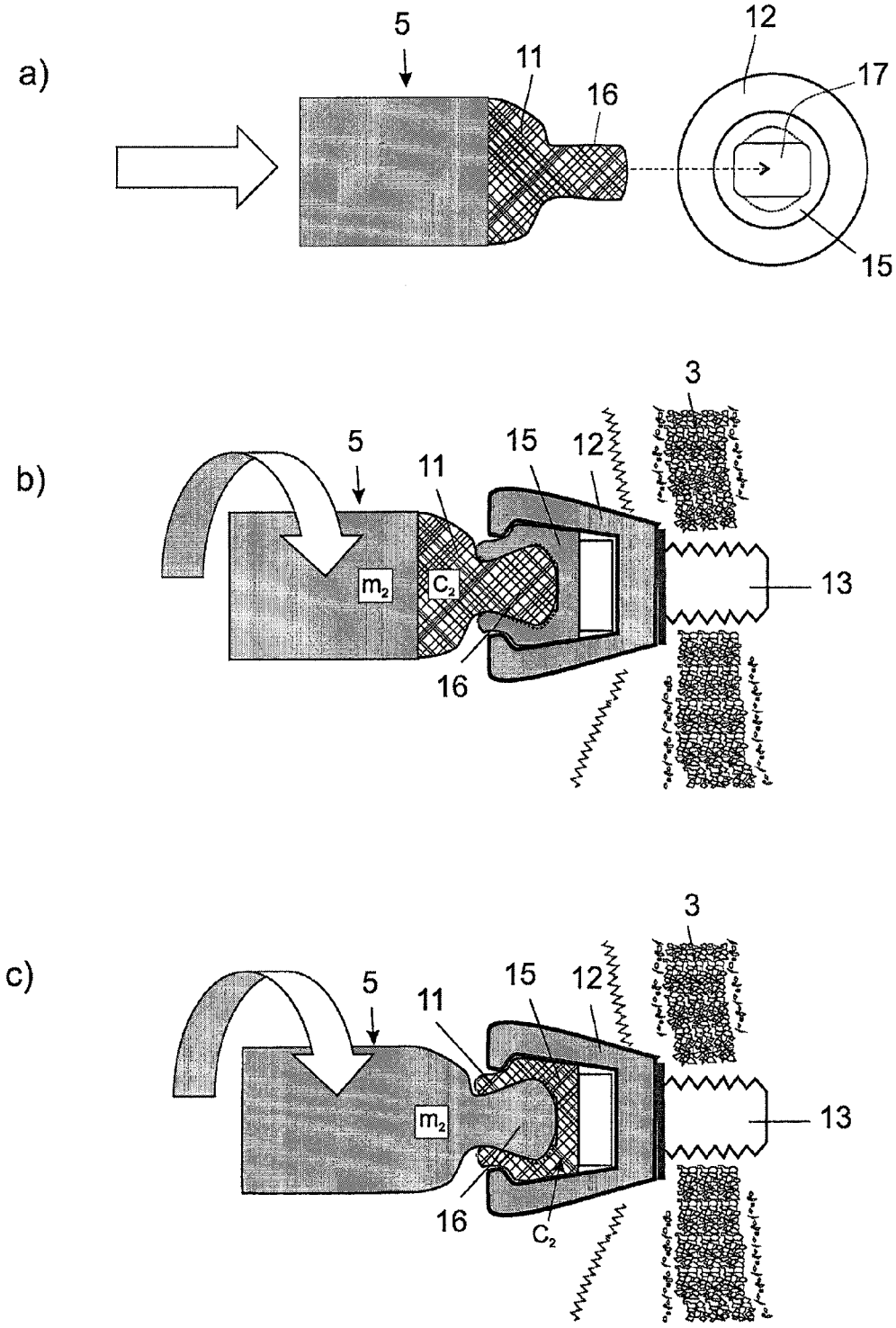
FIG. 7*a, b, c*: Cross-section of a preferred embodiment of the present invention for a attachment of external transducer by a bayonet coupling (a) where the compliant material are on the transducer side (b) or interiorly the abutment (c).

In FIG. 7*a,b,c*, the coupling between the driving mass unit (5) and the skin penetrating abutment is similar to in FIG. 5*a,b* but here the coupling is using a bayonet principle instead of a snapping principle. In FIG. 7*a* it is shown that the driving mass unit (5) of the transducer with the compliant member (11) on top constituting the bayonet male unit (16) is positioned into the adapter unit (15) in a slot or female part of bayonet coupling (17) then, as shown in FIG. 7*b* by the arrow, the coupling action is achieved by a turning motion by preferably 90 degrees. As shown in FIG. 7*c* the compliant member (11) can constitute the adapter unit 15 and hence the driving mass unit (5) is formed to constitute the male bayonet part (16).

It is evident from the embodiments of FIG. 2, 3, 5, 6, 7 each individually or in combination that there are a number of different possibilities to introduce the compliant member C2 in between the driving mass unit 5 and the mechanical load $Z_{load}$. Even if the specific solutions are different the technical effect i.e. enhancing the high frequency response applies to all embodiments. This is further strengthened by that the electro-mechanical analogue models in FIG. 3 apply to all possible embodiments under this innovation.

In spite of the fact that all embodiments have been presented to describe the invention it is evident that the one skilled in the art may modify, add or reduce details without diverging from the scope and basics of the present invention as defined in the following claims.

REFERENCE NUMBERS

[1] Transducer
[2] Housing
[3] Skull bone
[4] Counter weight unit m1
[5] Driving mass unit m2
[6] Air gaps
[7] First suspension spring arrangement C1
[8] Second suspension spring arrangement C2
[9] Damping material R2
[10] Male snap unit
[11] Second compliant member C2, R2
[12] Skin penetrating abutment
[13] Bone anchored screw
[14] Female snap unit
[15] Adapter unit
[16] Bayonet male part
[17] Slot in adapter unit—female part

REFERENCES

Håkansson, B. Carlsson, P. and Tjellström, A., 1986. The mechanical point impedance of the human head, with and without skin penetration. Journal of the Acoustic Society of America, 80(4), 1065-1075.

Tjellström, A., Håkansson, B. and Granström, G. (2001). The bone-anchored hearing aids—Current status in adults and children, Otolaryngologic Clinics of North America, Vol. 34, No 2, pp 337-364.

Håkansson, B. E. V. (2003). The balanced electromagnetic separation transducer a new bone conduction transducer. Journal of the Acoustical Society of America, 113(2), 818-825.

Håkansson, B.; Eeg-Olofsson, M.; Reinfeldt, S.; Stenfelt, S.; Granström, G. (2008). Percutaneous Versus Transcutaneous Bone Conduction Implant System: A Feasibility Study on a Cadaver Head, Otology & Neurotology: Volume 29(8). pp 1132-1139.

The invention claimed is:

1. A bone conduction transducer device comprising a first seismic mass and a second mass connected to each other by a first spring suspension with compliance, where a coil and magnetic circuits are integrated into the two masses and generate dynamic forces in air gaps formed between the first and second masses when a current is supplied to the coil, and where the first mass and the first spring suspension creates a first mechanical resonance in a low frequency range, wherein a second mechanical resonance is created in a high frequency range by interaction between the second mass and a second spring suspension with compliance that is introduced between the second mass and a load.

2. The device according to claim 1, wherein the second mechanical resonance has its maximum sensitivity in the range between 1 kHz and 7 kHz.

3. The device according to claim 2, wherein the second spring suspension has an integrated dampening arrangement.

4. The device according to claim 2, wherein the second spring suspension is attached to a skull via a biocompatible housing of an implanted transducer.

5. The device according to claim 4, wherein the second spring suspension is formed by a blade spring attached to the second mass in one end and attached to a housing in its other end.

6. The device according to claim 2, wherein the second spring suspension is integrated in a coupling arrangement between the transducer and a bone anchored implant system.

7. The device according to claim 6, wherein the attachment of the second mass of the transducer to the bone anchored implant system is provided by a snap coupling where a male or female unit constitute the second spring suspension which is made of a material that inherently has the proper compliance and dampening to create the second resonance.

8. The device according to claim 6, wherein the attachment of the second mass of the transducer to the bone anchored implant system is provided by a bayonet coupling where a male or female unit constitute the second spring suspension which is made of a material that inherently has the proper compliance and dampening to create the second resonance.

9. The device according to claim 3, wherein the second spring suspension is attached to a skull via a biocompatible housing of an implanted transducer.

10. The device according to claim 9, wherein the second spring suspension is formed by a blade spring attached to the second mass in one end and attached to the housing in its other end.

11. The device according to claim 3, wherein the second spring suspension is integrated in a coupling arrangement between the transducer and a bone anchored implant system.

12. The device according to claim 11, wherein an attachment of the second mass of the transducer to the bone anchored implant system is provided by a snap coupling where a male or female unit constitute the second spring suspension which is made of a material that inherently has the proper compliance and dampening to create the second resonance.

13. The device according to claim 11, wherein an attachment of the second mass of the transducer to the bone anchored implant system is provided by a bayonet coupling where a male or female unit constitute the second spring suspension which is made of a material that inherently has the proper compliance and dampening to create the second resonance.

* * * * *